US010208557B2

(12) United States Patent
Keller

(10) Patent No.: US 10,208,557 B2
(45) Date of Patent: Feb. 19, 2019

(54) TOOL CATCH

(71) Applicant: Albert Peter Keller, Lemmon, SD (US)

(72) Inventor: Albert Peter Keller, Lemmon, SD (US)

( * ) Notice: Subject to any disclaimer, the term of this patent is extended or adjusted under 35 U.S.C. 154(b) by 302 days.

(21) Appl. No.: 14/991,364

(22) Filed: Jan. 8, 2016

(65) Prior Publication Data

US 2016/0201424 A1 Jul. 14, 2016

Related U.S. Application Data

(60) Provisional application No. 62/101,414, filed on Jan. 9, 2015.

(51) Int. Cl.
*E21B 33/072* (2006.01)

(52) U.S. Cl.
CPC ..... *E21B 33/072* (2013.01)

(58) Field of Classification Search
CPC ..... E21B 33/072
See application file for complete search history.

(56) References Cited

U.S. PATENT DOCUMENTS 3,556,209 A * 1/1971 Reistle, III ..... E21B 33/076 166/352
4,299,280 A * 11/1981 Greer ..... E21B 33/072 166/113
4,577,687 A * 3/1986 Lanmon, II ..... E21B 33/072 166/243
4,681,168 A * 7/1987 Kisling, III ..... E21B 33/072 166/381
5,848,646 A * 12/1998 Huber ..... E21B 17/046 166/297
6,059,042 A * 5/2000 Huber ..... E21B 17/046 166/377
6,651,746 B2 * 11/2003 Boyd ..... E21B 29/04 166/379
6,719,061 B2 * 4/2004 Muller ..... E21B 33/068 166/242.6
7,530,401 B2 * 5/2009 Smith ..... E21B 33/072 166/332.8
2008/0236838 A1 * 10/2008 Smith ..... E21B 33/072 166/373

* cited by examiner

*Primary Examiner* — Matthew R Buck
*Assistant Examiner* — Aaron L Lembo
(74) *Attorney, Agent, or Firm* — Synthesis Intellectual Property LLC; Samuel Brown

(57) ABSTRACT

A wire line tool trap has a central housing with an axial passage. The passage is sized and shaped to movably receive a cable and tool. A pair of housings have an interior that opens to the passage of the center portion. Each of a pair of catch blocks are disposed in a respective lateral housing. Each catch block has an inside catch end with an under face and an upper face. When the catch blocks are fully inserted, a passage is defined to permit the wire line to pass therethrough. The under faces form a concavity, and the upper faces form a top land. The concavity permits a tool to urge the catch blocks apart and into a retracted state. Thus, the tool can drawn upwardly between the catch blocks. The top land retains a tool thereon and prevents the downward passage of the tool past the blocks.

9 Claims, 7 Drawing Sheets

TOOL CATCH

FIELD OF THE INVENTION

The field of the present invention is tool catches for well tools, particularly with respect to wire-line tools used in well operations.

BACKGROUND

In the typical wire-line operation, a metal cable or wire-line is used to suspend and control various tools where the tools are to be employed below the surface of the earth within the interior of the well. When the tool is occasionally brought up too quickly or is, for whatever reason, severed or separated from the wire line, the tool catch operates to catch the separated tool and there by prevent its loss down hole. In particular, the tool catch is useful in preventing tool loss as a result of a broken line while performing swabbing operations.

Swabbing is a form of "well control" that releases bottom hole pressure in an oil well in order to "kick" the well off. After wells are first drilled, they are usually fractured by a pressurized liquid to help open up "production zones" where oil or gas can travel to from the surrounding vicinity of the well.

Swabbing rigs are used to remove the fluids from the production zones. These swabbing rigs normally have a winch with a cable and a foldable mast with a pulley on top. First, a swabbing rig operator must back the rig as close to the well as possible. Next, the operator raises the mast and moves it until it is aligned with the center of the well. Next, the operator lowers swabbing tools attached to a cable in and out of the well casing via a "winch drum". Here, the operator must be able to maintain control of the machine while taking into account the well's sound and depth.

The activities of the swabbing rig then allow for the removal of the liquids inside the well. Standard practice, with respect to a typical well, involves removing six or so barrels of fluid out of the well. This practice is referred to as a "run". Some wells may take just one run while other may require multiple runs. Removing these fluids then causes the bottom hole pressure to increase. This allows the oil or gas to be pushed out of the well to cause it to start "flowing". Oilfield workers may then start collecting and storing the natural resource that is being emitted from the well. As the well ages, the bottom pressure of the well may fall below the level required to push oil and gas out of the well. As a result of insufficient pressure, the well stops flowing and the swabbing process needs to be performed to restore favorable conditions for the well to operate.

When the swabbing tool is raised, a "crown-out" situation can occur where the swabbing tool is pulled too high or the line is damaged. Crown-out can cause the cable attached to the tool to break and as a consequence, the swabbing tool can drop into the well. Crown-out can occur when the operator of the rig is unsure of the position of the tool. While the cable typically includes markers to warn the rig operator when the tool is near the surface, for various reasons, such as operator inattention, or defective or poorly maintained equipment, tools can become detached and are dropped. Retrieving the dropped tool can be difficult, time consuming and expensive. Any amount of time that the well is not producing is costly.

SUMMARY

The invention is a safety device, referred to hereinafter as a tool catch or swab catch, which is positioned in or atop an oil well for swabbing operations or other wire line procedures that operates to prevent tools from falling down the well.

The tool catch is a spring loaded safety device, to install in or atop of a pipe in an oil well for swabbing or other wire-line procedures. In particular, the tool catch is employed in situations where there is a chance of crowning out the wire line equipment and dropping tools and so on down the well hole.

The tool catch may be used with a swabbing tool itself or a novel swab catch rod attached to a swabbing tool. The swab catch rod is used in a situation where the oil well is provided with a lubricator pipe that is too short to contain all of the tools.

One aspect of the invention provides a wire line tool trap, including a hollow, tubular housing having a center portion with an axial passage formed therethrough. The passage is sized and shaped to movably receive a wire line and a wire line supported tool. A pair of lateral housings is disposed on the center portion, each of the lateral housings having an interior that opens to the axial passage of the center portion. A pair of catch blocks is provided, each of the pair of catch blocks slidably, sealingly disposed in a respective one of the lateral housings and each catch block having an inside catch end with an angled under face and an upper angled face. When the catch blocks are in an inserted state, a passage is defined therebetween sized and shaped to permit the wire line to pass therethrough, the angled under faces cooperatively form a concavity, and the upper angled faces cooperatively form a top land, and wherein the concavity is shaped to permit a wire line supported tool to urge the catch blocks apart and into a retracted state and the tool to be drawn upwardly between the catch blocks and the top land is shaped to retain a tool thereon and prevent the downward passage of the tool past the catch blocks.

Other aspects of the invention provide a tool trap wherein the center portion and lateral housings are formed as a one-piece construction. The lateral housings according to the above each may have a lateral housing axis that is angled at about 45 degrees relative to the axis of the center portion. One or more circumferential seals may be provided between the catch blocks and the lateral housings or provided on the catch blocks. The catch blocks may be biased into a fully inserted state. The catch blocks may each be biased by a respective coil spring. The coil springs may each be housed in a respective biasing chamber, each biasing chamber disposed outboard of a respective one of the lateral housings. Each biasing chamber may be closed with a cap member. The catch blocks may each be provided with a control element. Each control element may extend through a respective cap member and connected to a respective one of the catch blocks to manually retract the catch blocks from the inserted state. The tool trap may further comprise a catch rod to attach to the wire line at an upper rod end and the tool at a lower rod end. The upper rod end may include a shoulder to abuttingly contact the top land of the catch blocks and arrest downward motion of the tool. The lower rod end may include a sloping surface to urge the catch blocks apart and permit the withdrawal of the tool from upwardly past the tool trap. The catch rod may have a middle portion that is of a lesser diameter that the upper rod end and the lower rod end and the passage is sized to permit the catch rod to move axially without displacing the catch blocks from an inserted state.

BRIEF DESCRIPTION OF THE FIGURES

For a more complete understanding of the disclosure, reference should be made to the following detailed description and accompanying drawing figures wherein.

While specific embodiments are illustrated in the figures, with the understanding that the disclosure is intended to be illustrative, these embodiments are not intended to limit the invention described and illustrated herein.

DETAILED DESCRIPTION

The following description of the invention uses terms or orientation that are intended to be interpreted with the invention installed in a desired, normal position in a well. For example, "vertical" means oriented generally "up/down" in direction according to the common usage and definition of the term, and whereas upper and lower are terms that are relatively higher and lower along the vertical direction and so on. The terms thus used are intended to set out relative positions of the various elements of the invention as depicted in the figures and in normal usage and not as terms of limitation.

Figure 1:
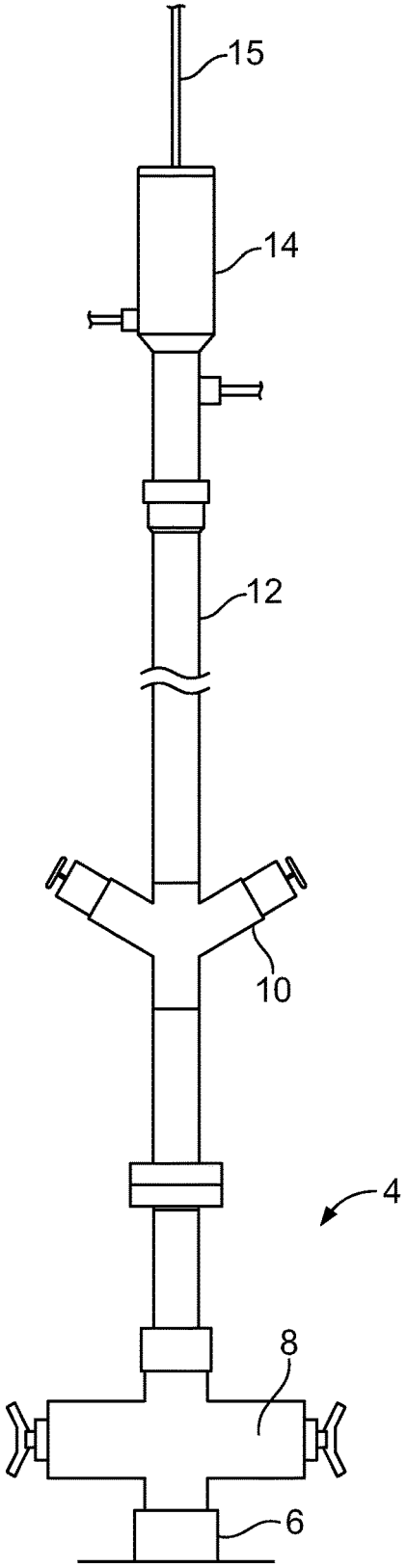
FIG. 1 shows one version of a well with a wire line tool trap according to an embodiment of the invention positioned on the well.

FIG. 1 is an example of a well 4 with tool catch 10 attached. The well includes a well head at the surface of the ground identified by the numeral 6. The equipment located above the well head may include a blowout preventer 8. The blowout preventer 8 is a safety device designed to close when the well achieves runaway flow. The blowout preventer 8 may be located immediately below the wire line tool trap 10 of this disclosure.

The equipment assembled to the well 4 may further utilize a lubricator 12. The lubricator 12 is installed above the wire line tool trap 10. A control head 14 may be affixed to the top of the lubricator 12. The numeral 15 identifies a wire line which extends from above the equipment to a down hole supported oil tool, such as a swab, for example. The nature of the tool itself is not critical; it is typically an elongate cylindrical body supported on the wire line 15.

Figure 2:
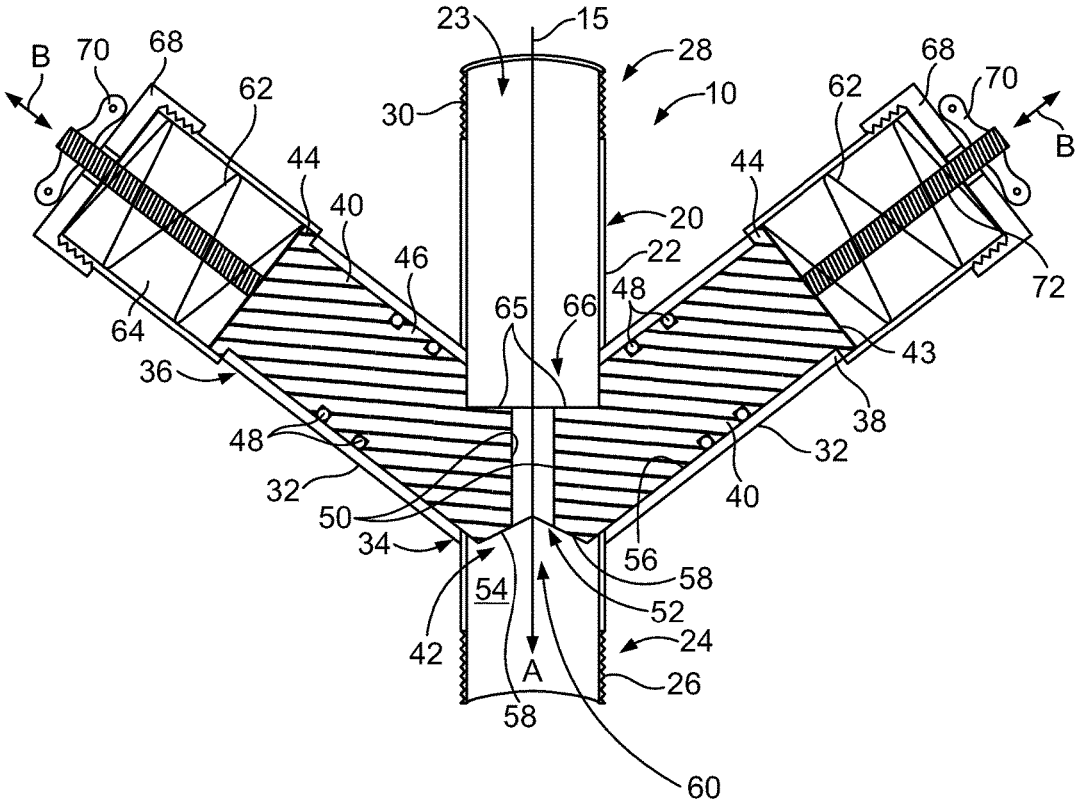
FIG. 2 shows a cross section of a wire line tool trap according to an embodiment of the invention.

FIG. 2 is an embodiment of the wire line tool trap 10. The tool trap 10 includes a housing 20 comprising a hollow body with a central portion 22 configured to be attached to the blowout preventer 8 or well head 6 at a lower end 24 thereof. The lower end 24 of body 22 may be provided with a thread or threads 26 for attaching to the well 4, or a well-known flange (not shown) which is bolted in place to a similar, mating feature. The upper end 28 of the central tubular body 22 may be provided with a thread or threads 30 for attaching to the well 4, or a flange (not shown) which is bolted in place to the lubricator 12, for example.

The tubular body 22 has a bore or interior 23 that has an axis A that is oriented vertically when assembled to the well 4. The bore 23 is sized and shaped to receive the tool (not shown) and cable 15.

The housing 20 includes a pair of lateral, opposed, cylindrical block casings, block housings or block sleeves 32. The block casings 32 may be formed in one piece with the body 22 or attached thereto by known methods of joining pipe sections and the like. The block housings 32 are lateral parts of or elements attached to the housing 20.

The block casings 32 may be angled relative to the axis of the central body 22. Preferably, the block casings 32 each have an axis B that is about 45 degrees relative to the axis A of the tubular body 22, wherein the axis B slopes downward approaching the tubular body. Also, the block casings 32 may be positioned on opposite sides of the body 22.

Each of the block casings 32 have a proximal end 34 and a distal end 36. The proximal ends 34 are open to the interior of the central tubular body 22. As noted above, the proximal ends 34 are of a lower elevation than the distal ends 36, when the trap 10 is mounted in position on the well 4. The distal ends 36 each include an annular end face 38 that may form a land or a similar stop.

Thus, the housing 20 comprising the body 22 defines a cylindrical central chamber 54 and one or more angled block chamber 56 defined by the block casings 32 that open into the central chamber.

A catch block 40 is slidably positioned within each one of the block casings. Each catch block 40 includes an inside end 42 that is movable to a position extending within the interior of the central tubular body 22. Each catch block 40 includes an outer end 43 that includes a flange 44 that is sized and shaped to stop against the annular end face 38. Each catch block 40 has a cylindrical middle portion 46 that is sized and shaped to slide within a respective block casing 32 and is provided with seals 48, such as, for example, O-ring type seals or the like.

The catch block inside ends 42 are configured to meet in the interior of the tubular body 22 when the catch blocks 40 are fully inserted into a respective block casing. The inside ends 42 each include a channel 50 formed therein. In this manner, the inside ends 42 permit a cable or the like to run through the blocks 40 and in and out of the well 4 when the blocks meet in the body 22 because the channels together define a vertical passage 52 therebetween. The passage 52 may be of a diameter that accommodates the cable, regardless of size, but does not permit the passage of the tool, for example.

Each of the catch blocks 40 at the inside catch end 42 has an angled face 58 formed so as to face downwardly when the catch block is positioned in the block housing 32 and in a fully inserted state. In this manner, the two catch blocks 40 meet in the central body 22. The channel 50 formed at the inside end 42 of each catch block thus cooperatively forms the cable passage 52 therebetween for the cable 15 to pass through unhindered. However, the channel 50 is smaller than the diameter of a tool or a stop feature (not shown) attached to the cable and prevents passage of the tool therethrough. The shape of the angled faces 58 of each of the catch blocks 40 when the catch blocks are fully inserted (as shown in FIG. 2) forms an upward concavity 60. When a tool, for example, is retracted from the well 4 the concavity causes the tool to force the blocks 40 apart with a wedging action, causing the blocks to be outwardly urged from the fully inserted state shown.

The blocks 40 are each urged into the fully inserted state shown in FIG. 2 by a respective biasing element 62, such as coil spring or an equivalent thereof, that is disposed against the outer end of the block. Thus, each block 40 is biased into the fully inserted state, forming the passage 52, while permitting the blocks to be pushed into a retracted state from the inserted state to allow tools to be withdrawn past the blocks and out of the well 4.

The biasing elements 62 may be housed within a biasing chamber 64, each biasing chamber located outboard of and axially aligned to a respective one of the block housings 32. The block housings 32 may be cylindrical pipes having an interior bore diameter that is greater than the diameter of the catch block 40.

The blocks 40 each at the the inside catch end 42 has a top face 65, opposite the angled face 58 configured such that the blocks, when fully inserted, cooperatively form a horizontal top land 66 for catching tools. The top land 66 faces upwardly when the catch blocks 40 are positioned in the block housing 32 in a fully inserted state. In this manner, the two catch blocks 40 meet in the central body 22 to form the land.

The biasing chamber 64 may be closed by a cap 68 that fits on or over the structure of the chamber. A control element 70, which may be in the form of a handle or the like with a rod member 72, which is attached to the blocks 40, may be provided on the cap 68 to manually manipulate the blocks into a retracted position for permitting the tool to be passed into the well past the top land 66. The attachment of the control elements 70 may be a threaded attachment to the blocks 40. The control element 70 may also serve as an indicator that shows when a tool is passing through the blocks 40, because the control element will respond to the blocks being urged into a retracted position by moving away from the cap 68.

Figure 3:
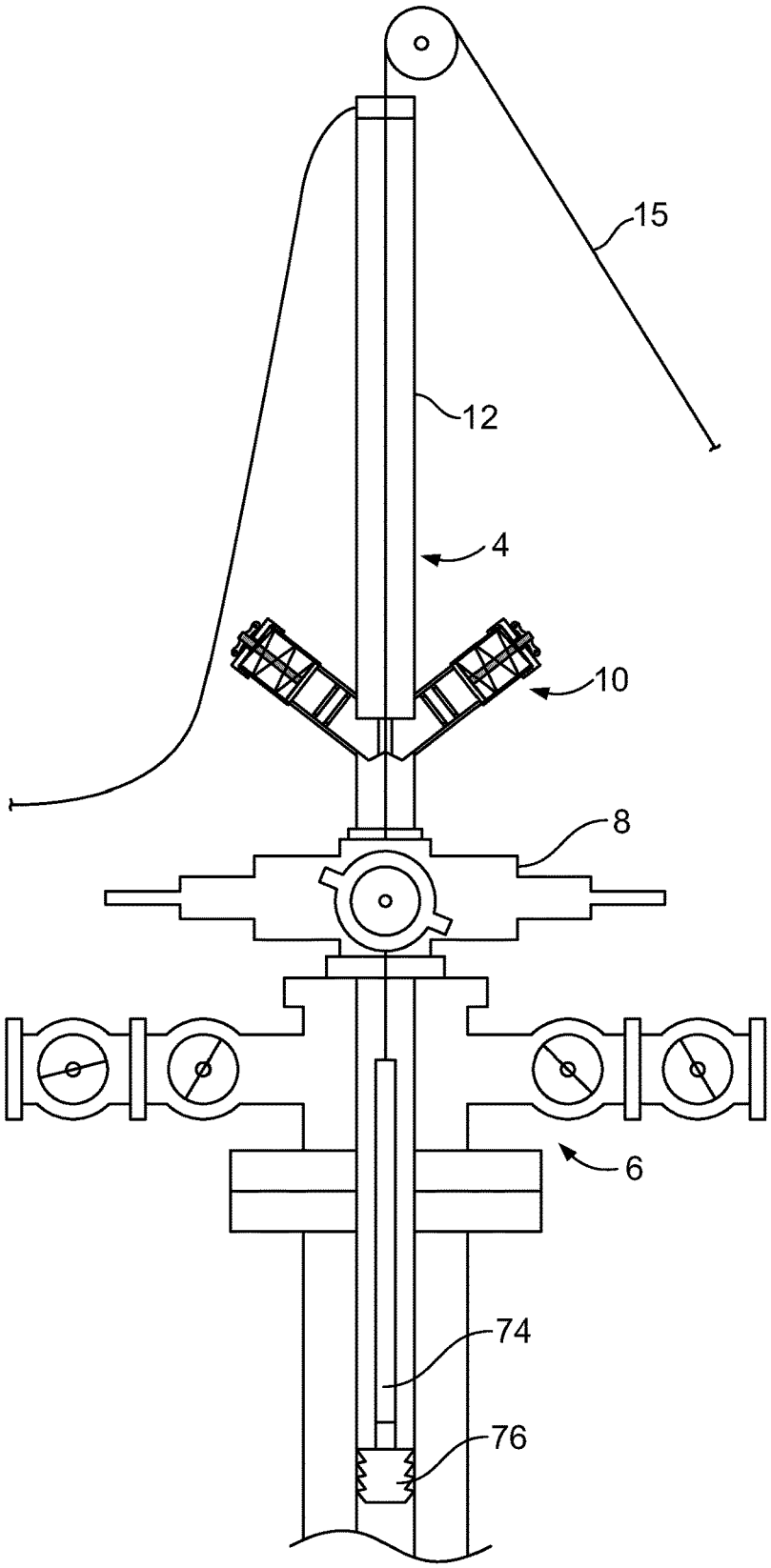
FIG. 3 shows a cross section of a well similar to that of FIG. 1 with a wire line tool in position and the path of the cable attached to the tool.

Turning to FIG. 3, the well 4 shows cable 15, one end of which is attached to a swab rig (not shown) as is well-known and the other end attached to a sinker bar 74, which itself is attached to a tool 76, such as a swab. Beginning at the top of the well assembly 4, the cable 15 passes through a lubricator pipe 12, through the passage 52 of the tool catch 10, through the blowout preventer 8 and into the well head 6. This positions the tool 76 in the production pipe of the well 4. The catch blocks 40 are shown in the closed or fully inserted position of the catch 10.

Figure 4:
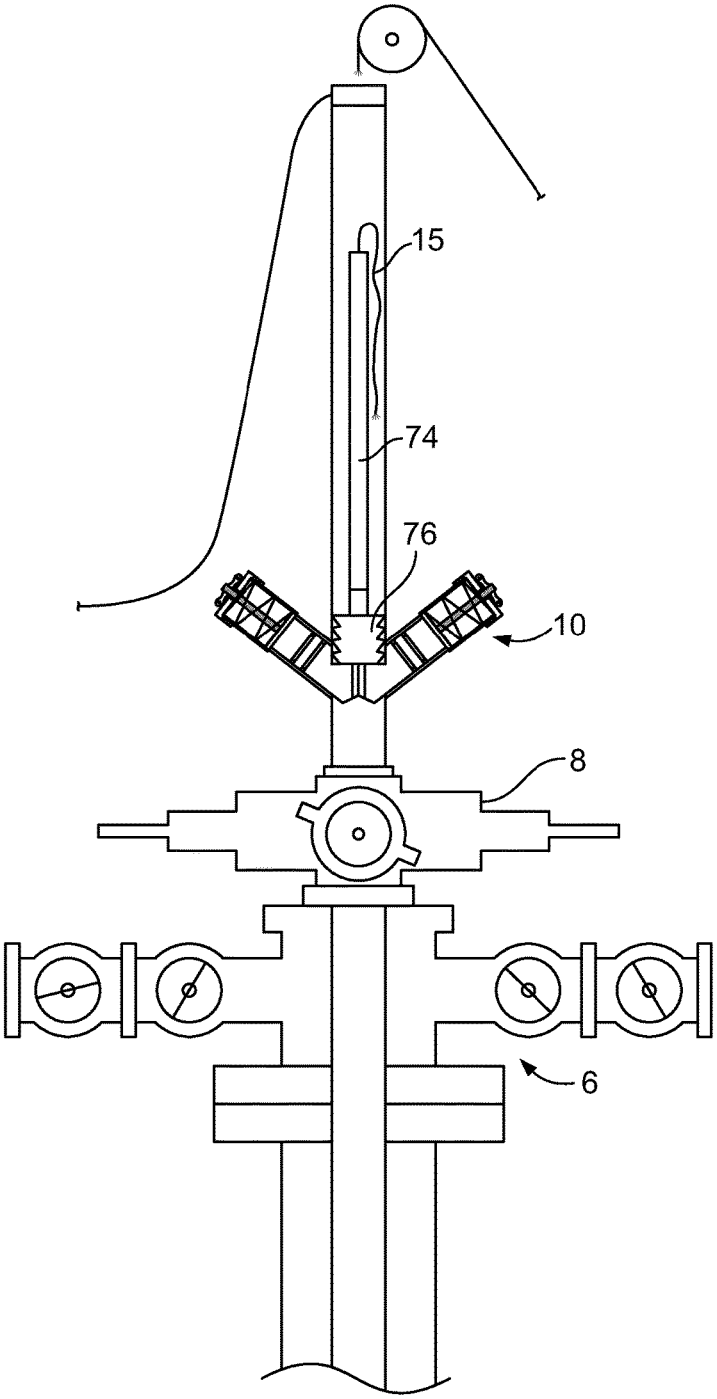
FIG. 4 shows a cross section of the well of FIG. 1 with the tool in position above and held by the tool trap.

FIG. 4 shows the position of the tool 76 above the tool catch 10 when the wire line 15 has broken and the tool has been caught by the blocks 40. In particular, the tool 76 is prevented from dropping into the production pipe by the top land 66 of the catch blocks 40.

Figure 5:
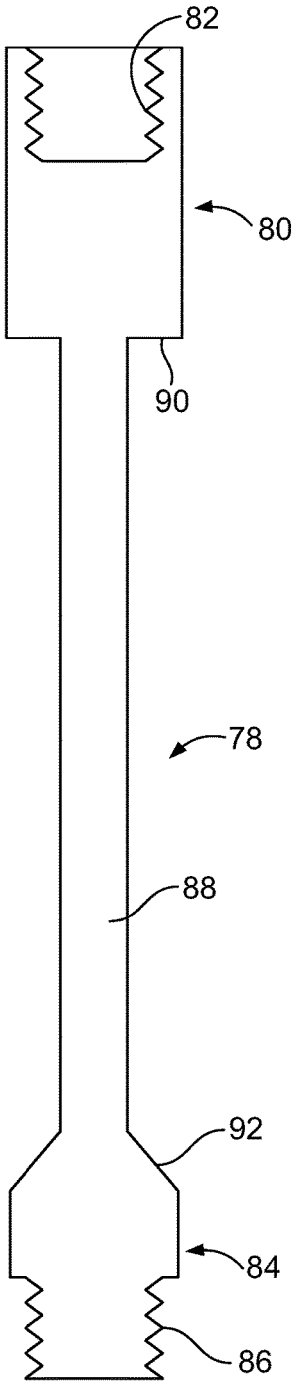
FIG. 5 shows a swab catch rod in detail.

FIG. 5 shows an optional swab catch rod 78, which is affixed to the top of the tool 76 when the well 4 is assembled with a short lubricator pipe 12. The catch rod 78 has an upper rod end 80 with a fastening means, such as an internal thread 82 and a first transverse diameter, e.g., 1.5 inches. The catch rod 78 has an lower rod end 84 with a fastening means, such as an outer thread 86 and a first transverse diameter, e.g., 1.5 inches. The catch rod 78 has a middle span 88 extending between the upper rod end and the lower rod end with a second diameter that is less than the first diameter, e.g., 0.75 inches. The diameter of the middle span 88 is preferably of a lesser diameter than the diameter of the passage 52 between the fully inserted blocks 40.

A radially extending shoulder 90 is formed between the upper rod end 80 and the middle span 88. The shoulder 90 extends radially, i.e., configured so that it will stop at and be arrested by the top land 66. A sloping surface 92 is formed between the middle span 88 and the lower rod end 84. The sloping surface 92 is shaped to urge the blocks 40 apart by contacting the angled under faces 58 of the blocks and urge the blocks into a retracted position to permit the catch rod 78 and attached tools to be withdrawn upwardly from the well.

Figure 6:
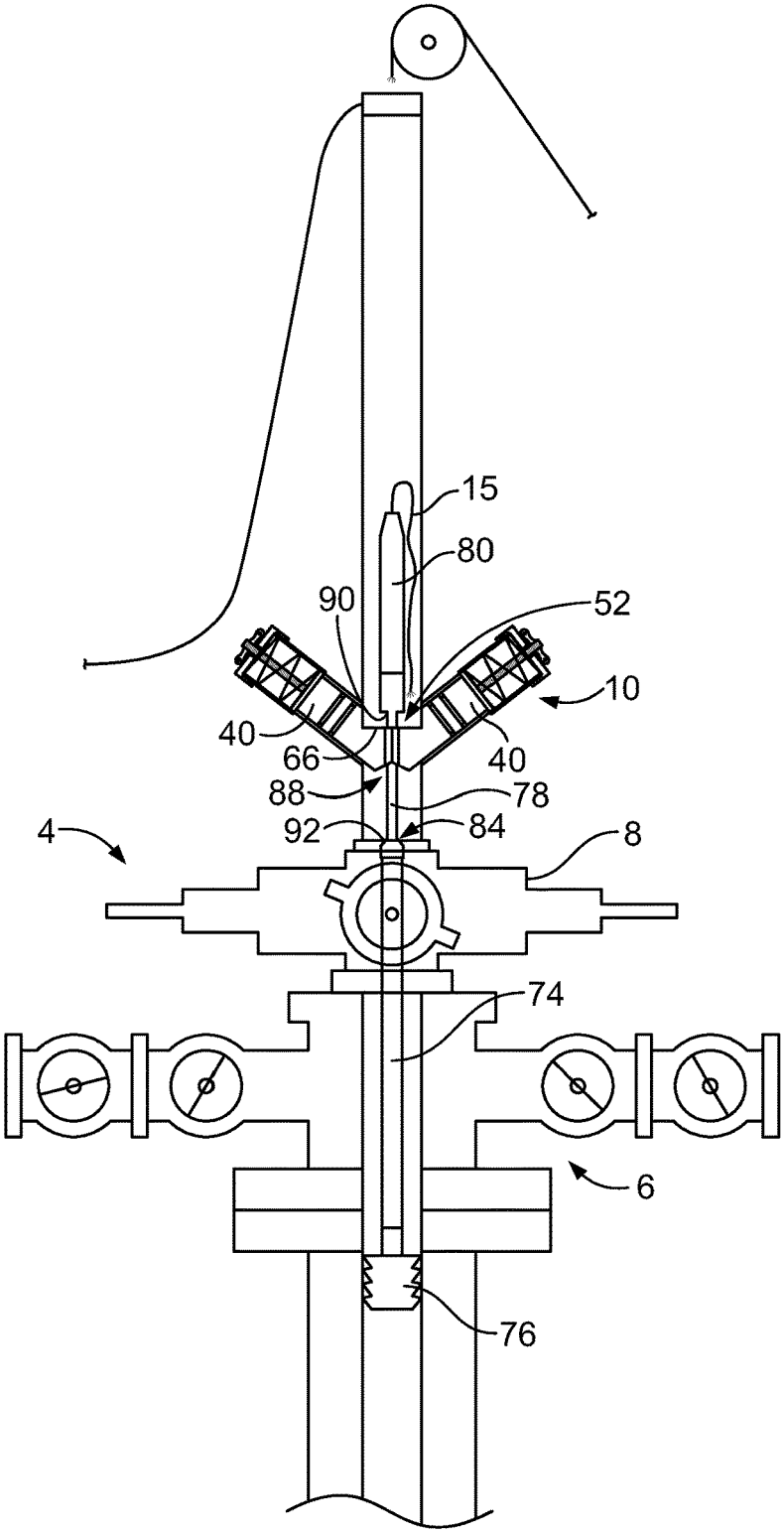
FIG. 6 shows a swab catch rod held by the tool trap

FIG. 6 shows a tool catch 10 with a catch rod 78 in a condition where the middle span 88 is positioned in the passage 52. The upper rod end 80 is above the catch blocks 40 and the lower rod end 84 is below the catch blocks with the tool 76 held underneath. If the wire 15 breaks at this point the radial shoulder 90 stops against the top land 66. If the tool 76 is drawn upwardly from the position shown, the sloping surface 92 urges the blocks 40 apart and the tool can be withdrawn from the well 4.

Figure 7:
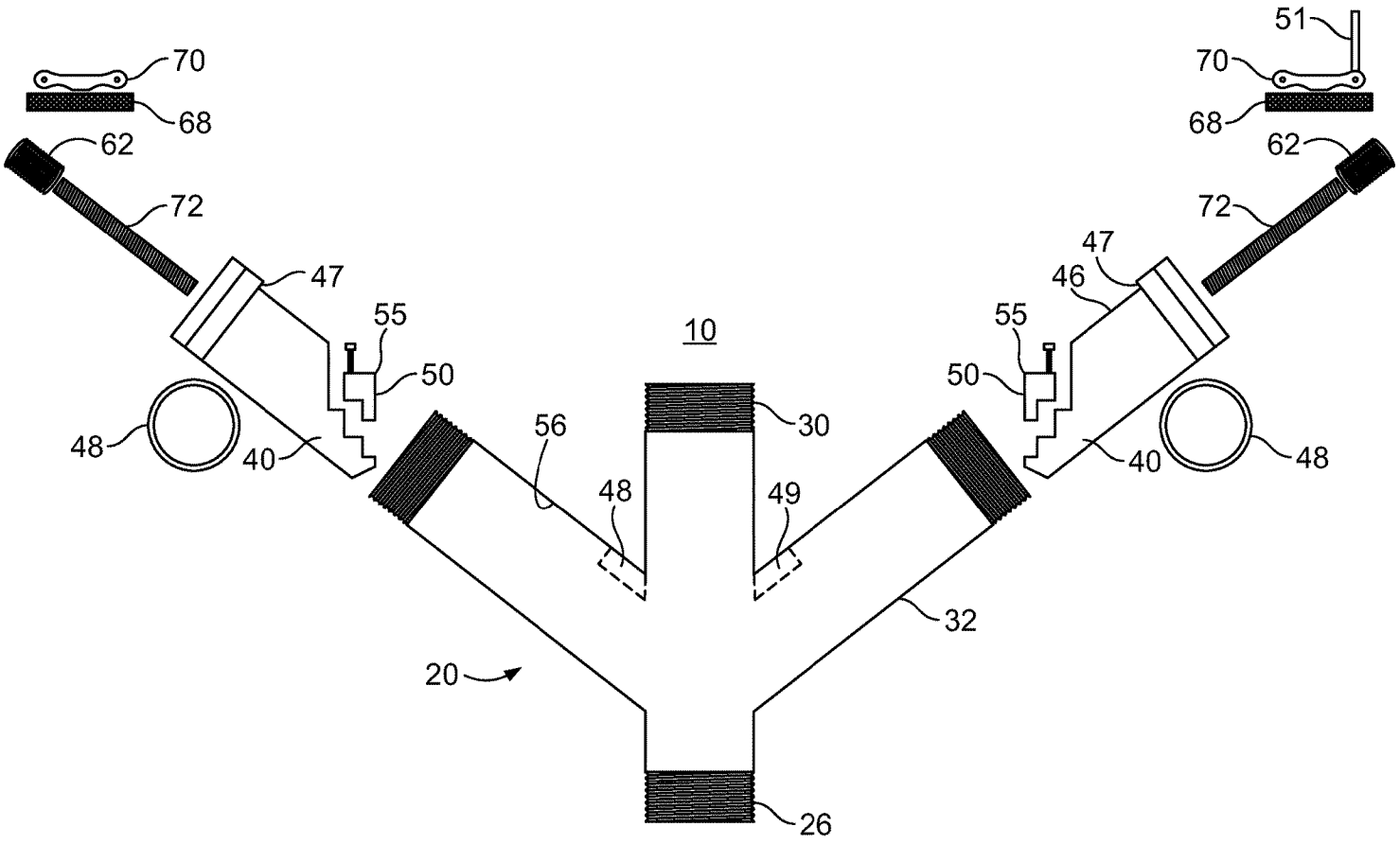
FIG. 7 shows an exploded view of the tool catch.

FIG. 7 shows an exploded view of the tool catch 10 with an alternative version of the blocks 40. The tool trap 10 includes a housing 20 with upper and lower threads 30, 26 to attach the trap in place in a well. Block housings 32 includes angled block chambers 56, each including a stop block 49. The catch blocks 40 are disposed in respective ones of the angled block chambers 56 and provided with seals 48 thereabout to seal the blocks to the chambers. The seals 48 may be metallic or polymeric, for example. Each block 40 includes a shoulder 47 formed along the middle portion 46 thereof to abut a stop block 49 so as to position the block in the chamber 56 in the fully inserted state. The blocks 40 may include a removable insert 55 to provide a range of cable channels 50 to define different sized passages 52 therebetween (see FIG. 2). Also illustrated is the tool catch 10 elements attached to the housing 20 including shafts 72, which are attachable to respective blocks 40, the caps 68 attachable to the block housings 32 with springs 62 positioned between cap and block. The handle 70 is attachable to the shaft 72, with optional hand crank element 51 attached to the handle.

Figure 8:
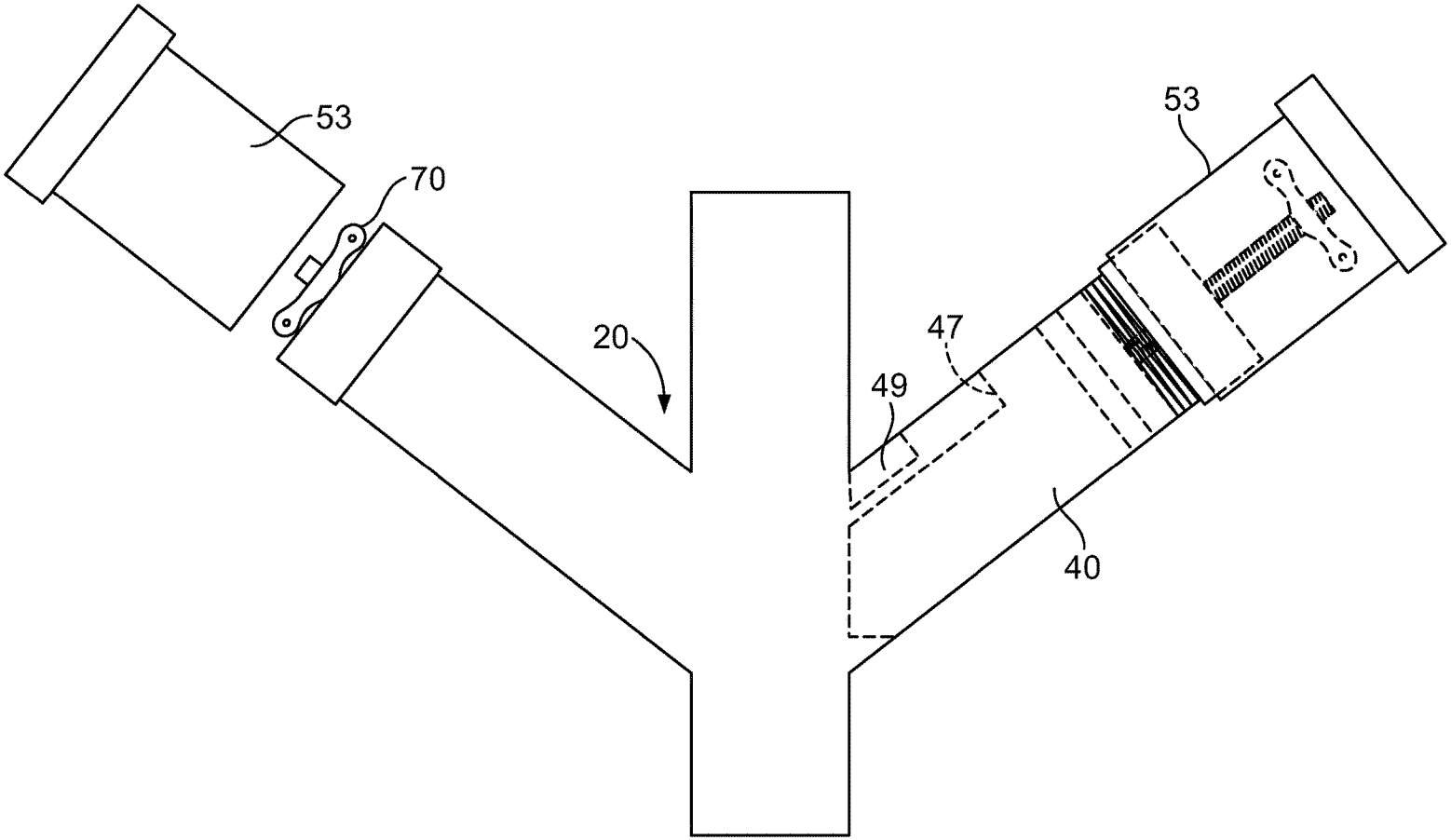
FIG. 8 shows an alternative feature of the tool catch.

FIG. 8 illustrates an optional cover 53 attachable to housing 20 to cover the handle 70. Also shown is the manner in which the block 40 shoulder 47 aligns with and may contact the stop block 49.

While specific embodiments are illustrated in the figures and described herein, these embodiments are not intended to limit the invention.

What is claimed:

1. A wire line tool trap, comprising:

a hollow, tubular housing having a center portion with an axial passage formed therethrough, the passage sized and shaped to movably receive a wire line and a wire line supported tool;

a pair of lateral housings disposed on the center portion, each of the lateral housings having an interior that opens to the axial passage of the center portion;

a pair of catch blocks, each of the pair of catch blocks slidably, sealingly disposed in a respective one of the lateral housings, each catch block having an inside catch end with an angled under face and an upper angled face, wherein when the catch blocks are in an inserted state, a passage is defined therebetween sized and shaped to permit the wire line to pass therethrough, the angled under faces cooperatively form a concavity, and the upper angled faces cooperatively form a top land, wherein the concavity is shaped to permit the wire line supported tool to urge the catch blocks apart and into a retracted state and the tool to be drawn upwardly between the catch blocks and the top land is shaped to retain the tool thereon and prevent the downward passage of the tool past the catch blocks, wherein one or more circumferential seals are provided between the catch blocks and the lateral housings, wherein the one or more circumferential seals are provided on the catch blocks.

2. The tool trap of claim 1, further comprising a catch rod to attach to the wire line at an upper rod end and the tool at a lower rod end.

3. The tool trap of claim 2, wherein the upper rod end includes a shoulder to abuttingly contact the top land of the catch blocks and arrest downward motion of the tool.

4. The tool trap of claim 3, wherein the lower rod end includes a sloping surface to urge the catch blocks apart and permit the withdrawal of the tool from upwardly past the tool trap.

5. The tool trap of claim 4, wherein the catch rod has a middle portion that is of a lesser diameter that the upper rod end and the lower rod end and the passage is sized to permit the catch rod to move axially without displacing the catch blocks from an inserted state.

6. A wire line tool trap, comprising:

a hollow, tubular housing having a center portion with an axial passage formed therethrough, the passage sized and shaped to movably receive a wire line and a wire line supported tool;

a pair of lateral housings disposed on the center portion, each of the lateral housings having an interior that opens to the axial passage of the center portion;

a pair of catch blocks, each of the pair of catch blocks slidably, sealingly disposed in a respective one of the lateral housings, each catch block having an inside catch end with an angled under face and an upper angled face, wherein when the catch blocks are in an inserted state, a passage is defined therebetween sized and shaped to permit the wire line to pass therethrough, the angled under faces cooperatively form a concavity, and the upper angled faces cooperatively form a top land, wherein the concavity is shaped to permit the wire line supported tool to urge the catch blocks apart and into a retracted state and the tool to be drawn upwardly between the catch blocks and the top land is shaped to retain the tool thereon and prevent the downward passage of the tool past the catch blocks, wherein the catch blocks are biased into a fully inserted state, wherein the catch blocks are each biased by a respective coil spring, wherein the coil springs are each housed in a respective biasing chamber, each biasing chamber disposed outboard of a respective one of the lateral housings.

7. A wire line tool trap, comprising:

a hollow, tubular housing having a center portion with an axial passage formed therethrough, the passage sized and shaped to movably receive a wire line and a wire line supported tool;

a pair of lateral housings disposed on the center portion, each of the lateral housings having an interior that opens to the axial passage of the center portion;

a pair of catch blocks, each of the pair of catch blocks slidably, sealingly disposed in a respective one of the lateral housings, each catch block having an inside catch end with an angled under face and an upper angled face, wherein when the catch blocks are in an inserted state, a passage is defined therebetween sized and shaped to permit the wire line to pass therethrough, the angled under faces cooperatively form a concavity, and the upper angled faces cooperatively form a top land, wherein the concavity is shaped to permit the wire line supported tool to urge the catch blocks apart and into a retracted state and the tool to be drawn upwardly between the catch blocks and the top land is shaped to retain the tool thereon and prevent the downward passage of the tool past the catch blocks, wherein the catch blocks are biased into a fully inserted state, wherein the catch blocks are each biased by a respective coil spring, wherein the coil springs are each housed in a respective biasing chamber, each biasing chamber disposed outboard of a respective one of the lateral housings, wherein each biasing chamber is closed with a cap member.

8. The tool trap of claim 7, wherein the catch blocks are each provided with a control element.

9. The tool trap of claim 8, wherein each control element extends through a respective cap member and connected to a respective one of the catch blocks to manually retract the catch blocks from the inserted state.

* * * * *